US005425971A

United States Patent [19]

Chiang-Cheng

[11] Patent Number: 5,425,971

[45] Date of Patent: Jun. 20, 1995

[54] STRUCTURE FOR COSMENTIC CASE

[76] Inventor: Hsiu-Yuan Chiang-Cheng, No. 36, Alley 11, Lane 794, Chung-Chen Rd., Kuei-Jen Hsiang, Tainan Hsien,

[21] Appl. No.: 105,092

[22] Filed: Aug. 11, 1993

[51] Int. Cl.[6] ..... A45D 33/22; B65D 6/00

[52] U.S. Cl. ..... 428/28; 206/823; 428/34.1

[58] Field of Search ..... 428/7, 28, 34.1; 220/8; 206/515, 822, 823

[56] References Cited

U.S. PATENT DOCUMENTS

| | | | |
|---|---|---|---|
| 2,885,134 | 5/1959 | Cohen | 206/515 X |
| 3,669,001 | 6/1972 | Asen | 206/515 X |
| 4,968,565 | 11/1990 | Stefano | 428/28 X |
| 4,978,021 | 12/1990 | Mini et al. | 220/8 |

FOREIGN PATENT DOCUMENTS

| | | | |
|---|---|---|---|
| 637078 | 2/1962 | Canada | 428/34.1 |
| 549675 | 12/1942 | United Kingdom | 428/28 |

*Primary Examiner*—Henry F. Epstein

*Attorney, Agent, or Firm*—Pro-Techtor International

[57] ABSTRACT

A new structure for a multi-layered cosmetic case having a shape of a circular tower, the upper most layer is a top cover with a knob which serve as a finger grip to flip the top cover open. The middle layer is a box body which can be turned to open. The bottom layer has two different box bodies, the top box body can be open up by turning, the two bottom box bodies are semi-circular in shape which can be swung open from the left and the right hand side. The circular-tower-shaped multi-layered cosmetic case can be opened in many ways for access of the cosmetics.

2 Claims, 3 Drawing Sheets

STRUCTURE FOR COSMENTIC CASE

BACKGROUND OF THE INVENTION (a) Field of the Invention

The present invention relates to a new structure for cosmetic case for storing a variety of cosmetics, particularly to a multi-layered make-up case in which the cover can either be flipped or turned open.

(b) Description of the Prior Art

The majority of the portable cosmetic case available in the market today are of single-layered structure in which the cosmetic items it holds are limited. Most of the cosmetic items have to be placed in other places, causing an inconvenience to search for them when they are needed. Although multi-layered cosmetic cases are available today, their capacities to hold the cosmetic items are still limited. Items such as lipstick, eye liner, eye shadow applicator, mascaras and brow brush have to be placed in a different case. Generally, most of the makeup items are placed into one case, making it hard to identify and pick out one of the particular items. It is also messy to put all the makeup items into a single case.

SUMMARY OF THE INVENTION

The main object according to the present invention is to provide a multi-layered cosmetic case so that daily cosmetic items can be grouped and placed into different layers of the case.

Another object according to the present invention is to provide a new structure for a cosmetic case such that its overall appearance is more appealing.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
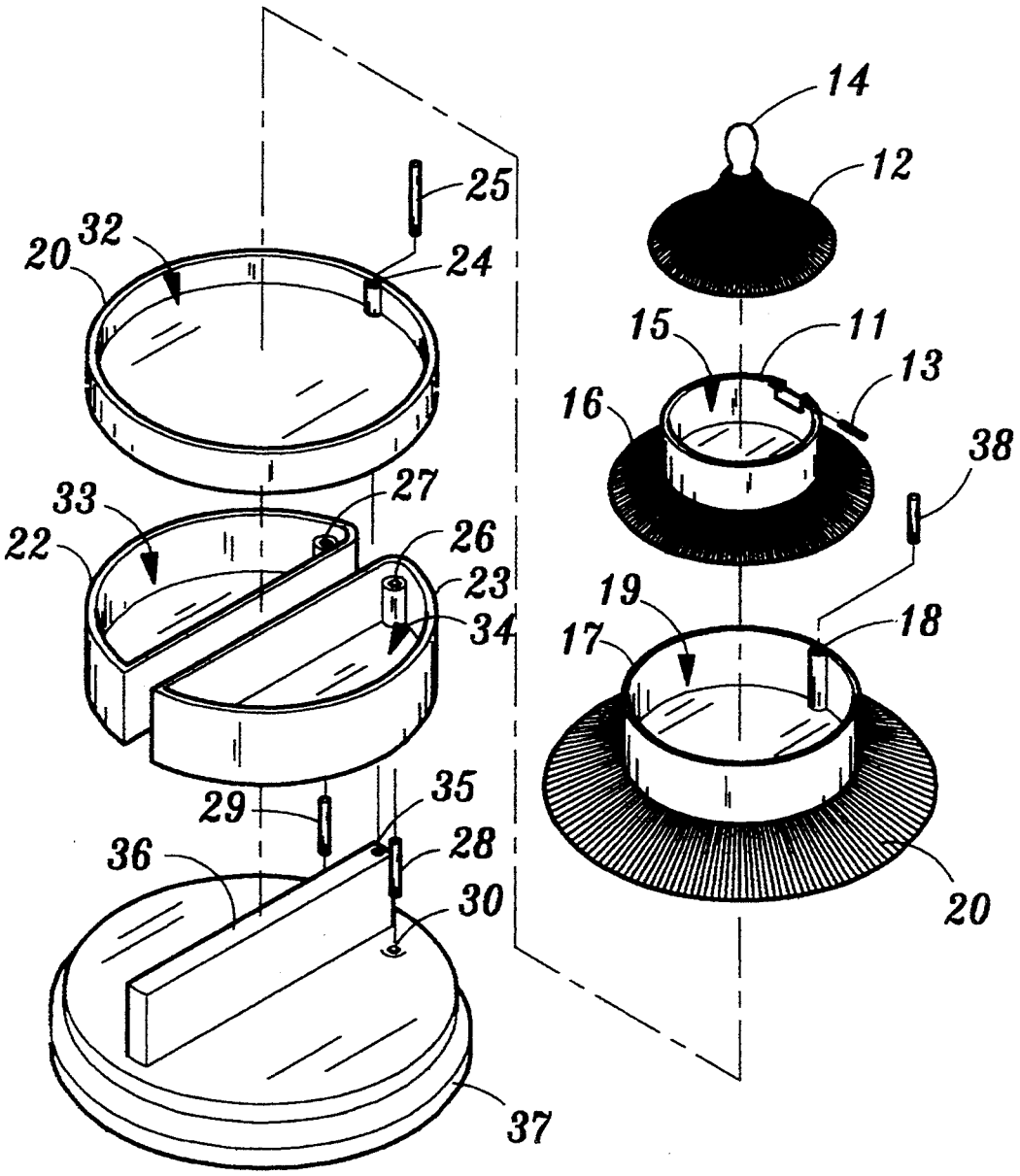
FIG. 1 is a perspective fragmented view of the cosmetic case according to the present invention.

Referring to FIG. 1, the new structure for the cosmetic case according to the present invention mainly consists of an upper box 11 having a top cover 12 hinged to it through a hinged pin 13, said cover 12 is constructed to be able to flip open. On the top of the top cover 12 is a circular knob 14 such that the top cover 12 can be flipped open by hand. When the top cover 12 is opened, the box 11 has a hollow space 15 for storage of cosmetic items. The bottom surface of the box 11 is an upper flange 16, under which is a middle box 17 which has a hinged member 18. A pin 38 is used to join the middle box 17 to the upper box 11 together. It is specially constructed that the middle box is rotatable using the pin 38 as the center of rotation. When the center box 17 is rotated to open, it also has a hollow space 19 for storage of makeup items and its bottom surface is a middle flange 20. Beneath the middle box 17 is a storage area comprising an upper and a lower portion. The top portion is a circular rotatable box 21, and the bottom portion includes a partition 36 which separates the bottom portion into two semi-circular rotatable boxes 22 and 23. The circular box 21 has a pin hole 24 which a pin 25 can be inserted to join the circular box 21 together with the middle box 17, allowing the circular box 21 to be rotatable around the pin 25. The end of the pin 25 is also inserted into a pin hole 35 on the partition 36 of the base 37. When the circular box 21 is rotated, a hollow space 32 is provided inside for storage of makeup items. The two semi-circular rotatable boxes 22 and 23 also are constructed with pin holes 26 and 27. The base 37 also has two pin holes 30 which are correspond in pairs to the pin holes 26 and 27. Using two inserted pins 28 and 29 to insert into the pin holes 26 and 27 and its corresponding pin holes 30, the two semi-circular boxes 22 and 23 on the partition 36 of the base 37. With the inserted pins 28 and 29 as the pivotal point, the two semi-circular boxes 22 and 23 can be swung out for opening. Both of the boxes 22 and 23 have internal empty spaces 33 and 34 for storage of the cosmetics.

Figure 2:
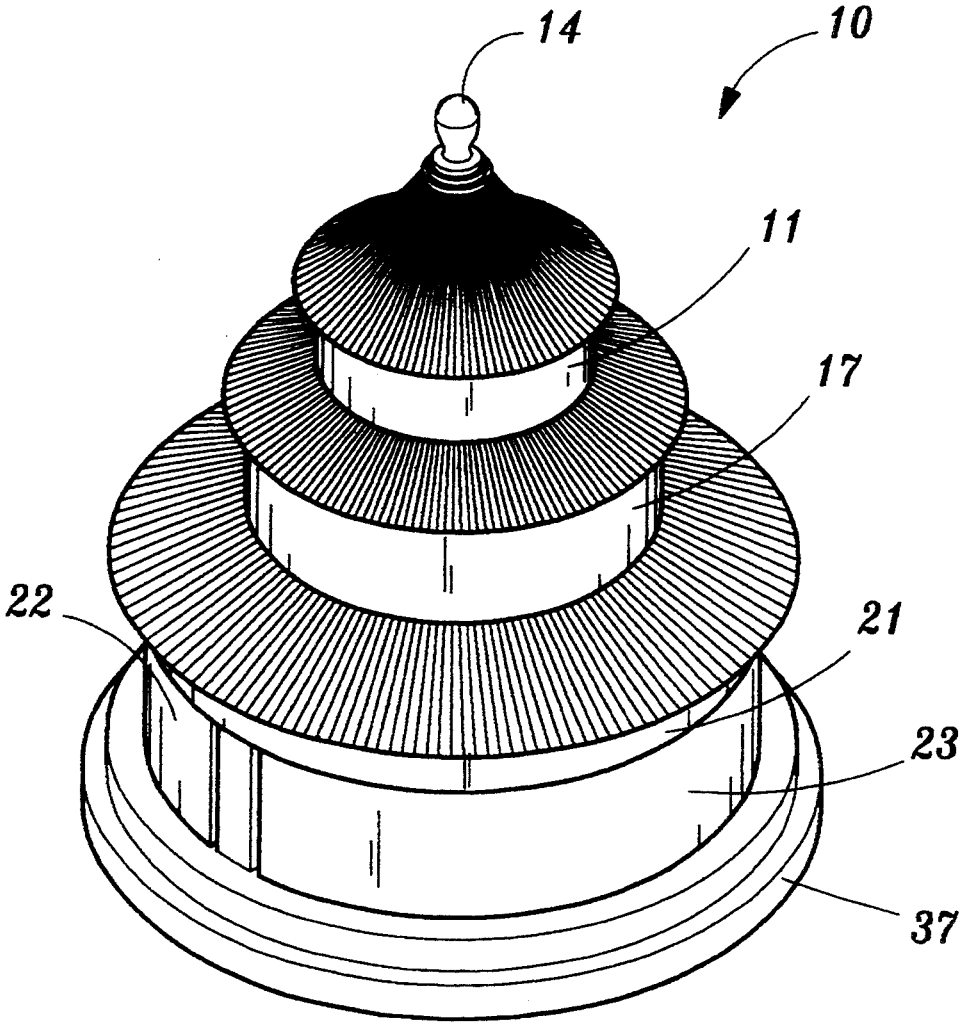
FIG. 2 is a perspective view of an assembly of the cosmetic case according to the present invention.
Figure 3:
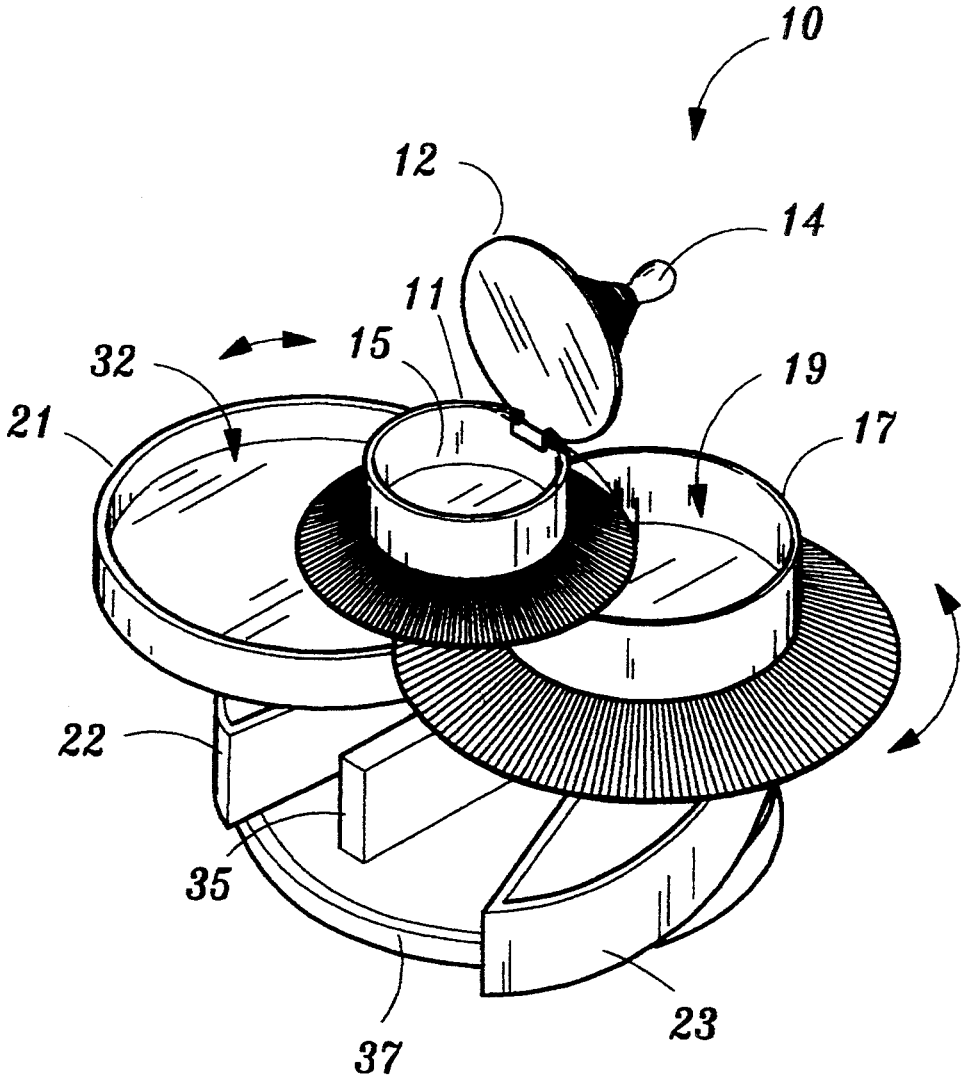
FIG. 3 is a perspective view of an assembly showing each layer of the cosmetic case in an open position according to the present invention.

Referring to FIGS. 2 and 3, the new structure of the cosmetic case 10 according to the present invention has a shape similar to a tower. In use, the upper box 11, the middle box 17 and the lower boxes 21, 22 and 23 form the multi-layered cosmetic case. The top cover 12 on top of the upper case 11 can be flipped open by gripping on the knob 14, then the hollow space 15 of the upper box 11 can be used to store cosmetics. The middle box can be turned to open in the arrow direction. The circular box 21 of the lower box can also be turned to open in the arrow direction as shown in FIG. 3. The other two semi-circular boxes 22 and 23 can be swung out on the left and the right hand side.

In summary, the cosmetic case according to the present invention has a circular tower shape with multi layers of boxes for storing the makeup items. Each of the box in the layer are opened in a different way. They can either be flipped, turned or rotated to open. The multi-layered design allows the cosmetics be sorted out for easy selection.

Although one embodiment of the invention is illustrated in the drawings and described in detail, this invention contemplates any configuration, design and relationship of components which will function in a similar manner and which will provide the equivalent result.

What is claimed is:

1. A structure for a cosmetic case comprising:

multiple boxes stacked in layers, a top cover including a knob used as a finger grip to flip open the top cover, and a base of the cosmetic case; wherein the boxes pivot around pivot axes, at least one central box layer rotating to expose the interior of the box without raising the top cover; and wherein at least one lower box layer comprises two semi-circular boxes with a partition therebetween, the two semi-circular boxes pivoting on axes so that the two semi-circular boxes may be swung open, one to the left and one to the right.

2. The structure for a cosmetic case as claimed in claim 1 wherein:

the number of layers of boxes is varied by the user according to the user's needs.

* * * * *